US009103608B2

(12) United States Patent
Dumortier et al.

(10) Patent No.: US 9,103,608 B2
(45) Date of Patent: Aug. 11, 2015

(54) FIREARM WITH IMPROVED RELOADING

(71) Applicant: BROWNING INTERNATIONAL, SOCIETE ANONYME, Herstal (BE)

(72) Inventors: Thierry Dumortier, Hermee (BE); Claude Dodrimont, Bolland (BE)

(73) Assignee: BROWNING INTERNATIONAL, SOCIETE ANONYME, Herstal (BE)

( * ) Notice: Subject to any disclaimer, the term of this patent is extended or adjusted under 35 U.S.C. 154(b) by 208 days.

(21) Appl. No.: 13/875,959

(22) Filed: May 2, 2013

(65) Prior Publication Data

US 2013/0298436 A1 Nov. 14, 2013

(30) Foreign Application Priority Data

May 14, 2012 (BE) ..... 2012/0318

(51) Int. Cl.
*F41A 3/12* (2006.01)
*F41A 3/20* (2006.01)
*F41A 3/78* (2006.01)

(52) U.S. Cl.
CPC ... *F41A 3/12* (2013.01); *F41A 3/20* (2013.01); *F41A 3/78* (2013.01)

(58) Field of Classification Search
CPC ..... F41A 3/12; F41A 19/30; F41A 3/78; F41A 19/29; F41A 19/36; F41A 3/80; F41A 3/82; F41A 3/20
USPC ..... 42/17, 16
See application file for complete search history.

(56) References Cited

U.S. PATENT DOCUMENTS

| | | | | | |
|---|---|---|---|---|---|
| 1,057,329 | A | * | 3/1913 | Clarus | 89/154 |
| 1,071,023 | A | * | 8/1913 | Borohardt | 89/138 |
| 2,407,157 | A | * | 9/1946 | Hyde | 89/154 |
| 2,765,562 | A | * | 10/1956 | Roper et al. | 42/69.02 |
| 3,013,355 | A | * | 12/1961 | Weatherby | 42/16 |
| 3,580,132 | A | * | 5/1971 | Vartanian | 89/130 |
| 3,672,255 | A | * | 6/1972 | Findlay et al. | 89/42.01 |
| 3,931,690 | A | * | 1/1976 | Soucy et al. | 42/16 |
| 4,019,423 | A | * | 4/1977 | Johnson | 89/178 |
| 4,475,438 | A | * | 10/1984 | Sullivan | 89/191.01 |
| 2011/0232473 | A1 | * | 9/2011 | Gugliada | 89/162 |

FOREIGN PATENT DOCUMENTS

| | | | |
|---|---|---|---|
| DE | 211157 | C | 3/1907 |
| EP | 2 369 289 | A1 | 9/2011 |
| FR | 979.941 | A | 5/1951 |
| GB | 191209914 | A | 0/1913 |

OTHER PUBLICATIONS

KKF, Constant Force Springs, Jan. 17, 2013, http://catalog.lesjoforsab.com/pdf/en/chapters/112-118_EN.pdf.*

* cited by examiner

*Primary Examiner* — Joshua Freeman
(74) *Attorney, Agent, or Firm* — Sughrue Mion, PLLC

(57) ABSTRACT

Firearm comprising a receiver (2); a barrel (6) mounted with one end on the receiver (2); a breech (8) equipped with a loading lever (9) mounted, in a way so that it can slide, in the receiver (2); at least one return spring (15) to return the breech (8) to its closed position, characterized in that the return spring (15) is a tension spring of the 'constant-force' type that is mounted between the breech (8) and a fixed support (12) with respect to the receiver and the barrel.

16 Claims, 3 Drawing Sheets

FIREARM WITH IMPROVED RELOADING

FIELD OF THE INVENTION

The invention relates to the technical sector of firearms, and in particular repeater rifles with manual or automatic reloading.

BACKGROUND OF THE INVENTION

Such a firearm generally comprises a receiver; a barrel mounted with one end on the receiver; in this end a chamber to house a cartridge, a breech equipped with a loading lever mounted, in a way so that it can slide, in the receiver in the prolongation of the barrel between an open position enabling a cartridge to be loaded into the chamber of the barrel and a closed position pressed against the barrel; a bolt associated with the breech enabling the cartridge to be locked in the chamber; and at least one return spring to return the breech to its closed position.

Such a rifle is loaded by the movement of the breech from the back to the front, i.e. from the open position of the breech to the closed position of the breech under the effect of the return spring.

This movement of the breech carries a new cartridge from the magazine or a new cartridge placed manually in front of the chamber of the barrel in order to introduce it into the chamber. This movement also brings about the rotation of the bolt to lock the cartridge in the chamber before firing.

The reverse movement of the breech from the front to the back, i.e. the backward movement, unlocks the cartridge in the chamber of the barrel and extracts this cartridge from the chamber in order to be able to put a new cartridge in the chamber or to enable maintenance of the weapon.

The backward movement of the breech can be effected manually by operating the loading lever to empty the weapon or to feed a new cartridge into the chamber, or automatically or semi-automatically by using the pressure of the gases developed by the combustion of the powder in the cartridge during firing.

To effect the backward movement, the user must overcome the tensile force of the return spring.

In known weapons, the return spring is a conventional compression spring whose resistance to the backward movement increases progressively during the backward movement towards the rear, requiring an increasing effort.

This increasing effort generally leads to a lack of comfort and a loss of stability between shots.

The patent application GB09914 of 1912 discloses a fire arm utilising a return spring for the breech, fixed with one end to the breech and with the other end to a fixed shaft, the spring having the form of a torsion spring formed by a flat strip wound around a shaft in the form of a spiral, the windings not being in mutual contact in order for the spring to exert a torsion.

The return spring disclosed in GB 09914 is complex to manufacture, the cross-section of the strip not being constant. The pulling force exerted by the spring is moreover not constant.

SUMMARY OF THE INVENTION

The purpose of the invention is to overcome these disadvantages and to provide a simple and safe reloading device when the mobile breech automatically returns to its closed position as soon as it is no longer retained by the shooter via the loading lever.

This purpose is achieved according to the invention by a firearm as described above, characterised in that the return spring is a tension spring of the constant force type, which is mounted between the breech and a fixed support with respect to the receiver and the barrel.

Contrary to the use of a conventional compression spring, the characteristic of the constant-force spring is that the user feels a constant resistance while the breech moves backwards to disarm the weapon, which results in greater comfort of use and greater stability between shots.

The constant-force return spring is preferably composed of a flat strip wound around itself around a winding axis which is transversal to the axis of the barrel in the form of a flat spiral with joined windings which are in mutual contact.

During the backward movement of the breech, the spiral unwinds while being able to freely rotate around its winding axis, the inner free end of the return spiral not being retained from rotating, which involves a practically constant retaining force to resist the unwinding.

Preferably the spring is mounted on a bobbin in a way that it can freely rotate around a transverse shaft mounted in the housing, with the outer end of the spring being fixed to the barrel, preferably at the level of the forend support that the barrel is generally provided with.

The outer end of the spring may be fixed to the barrel by means of a positioning shaft that extends parallel to the axis of the barrel and in a centring hole provided in the housing when it is in the closed position.

The breech-housing assembly is thus centred each time that a cartridge is loaded in the chamber of the barrel.

Depending on the force required to load a cartridge in the chamber, and according to the available space in the forend, several constant-force springs may be used whose forces are combined.

According to a specific embodiment of the invention, the spring is confined in a housing that is associated with the breech, and which is mounted, in a way so that it can slide, in the forend by means of at least one side runner connecting the housing to the breech.

In this way the spring is protected against any infiltration of dirt that could hamper its good operation and allows a compact build of the firearm.

BRIEF DESCRIPTION OF THE DRAWINGS

For greater clarity, an example embodiment of a firearm with improved reloading according to the invention is described hereinafter by way of an example, without any limiting nature, with reference to the accompanying drawings, wherein.

DESCRIPTION OF A PREFERRED EMBODIMENT

Figure 1:
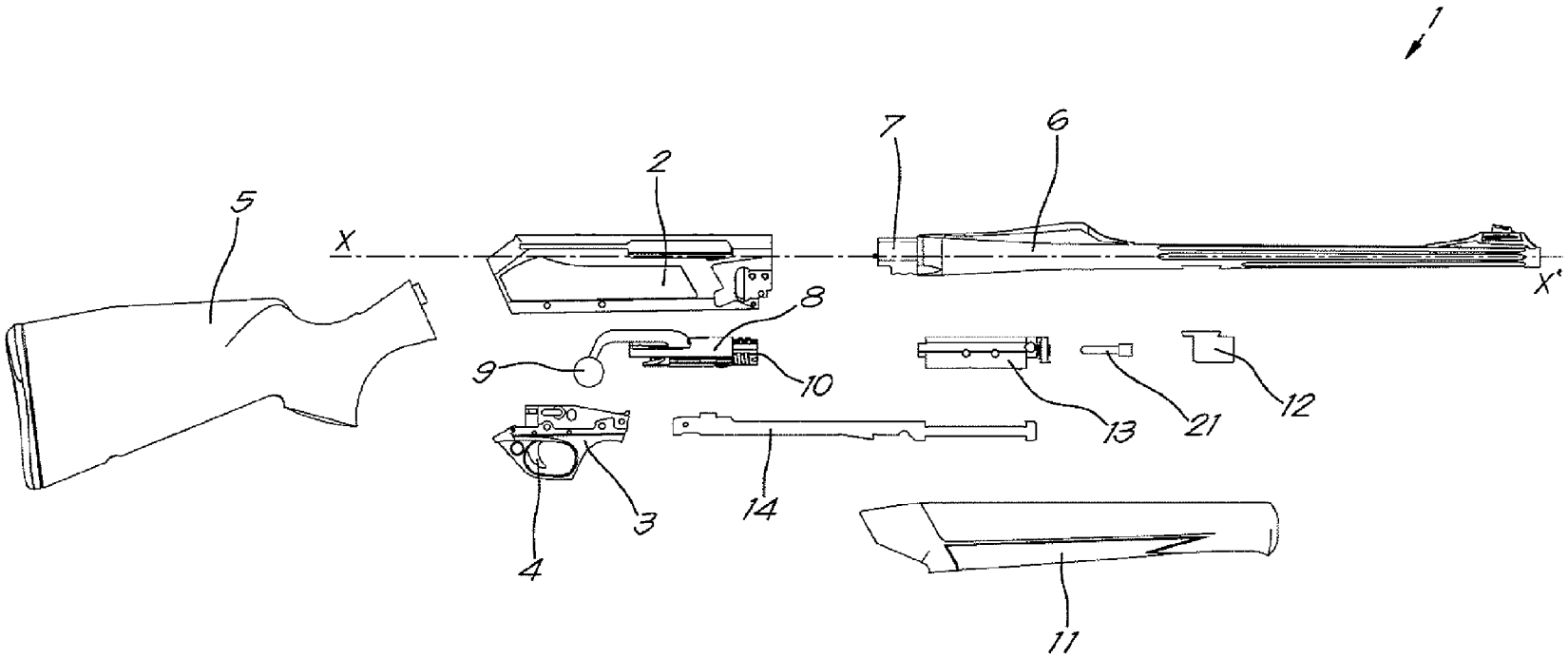
FIG. 1 schematically shows an exploded view of a firearm according to the invention with the breech in a closed position.
Figure 2:
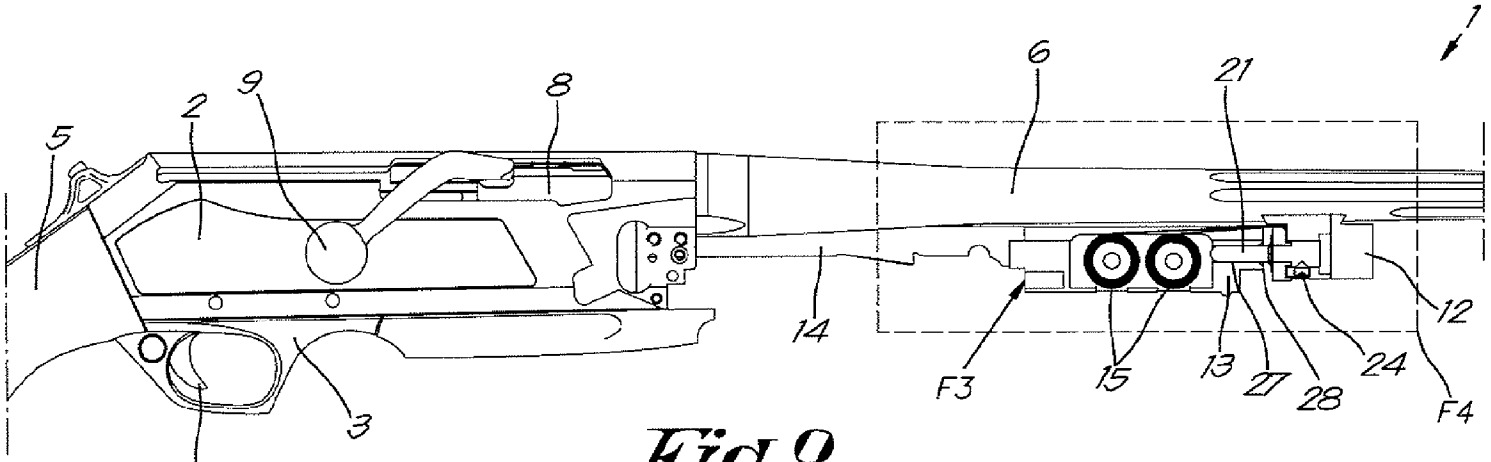
FIG. 2 shows the firearm of FIG. 1 in an assembled state and partially in cross-section.
Figure 3:
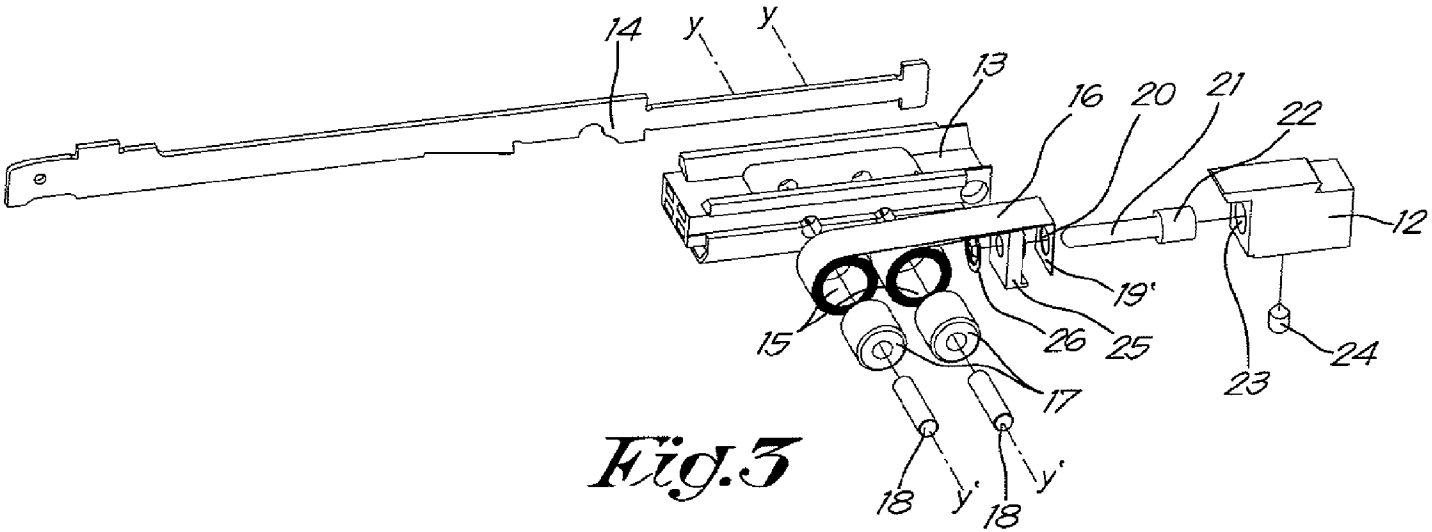
FIG. 3 shows a perspective view of the part indicated by F3 in FIG. 2 in a dismantled state.
Figure 4:
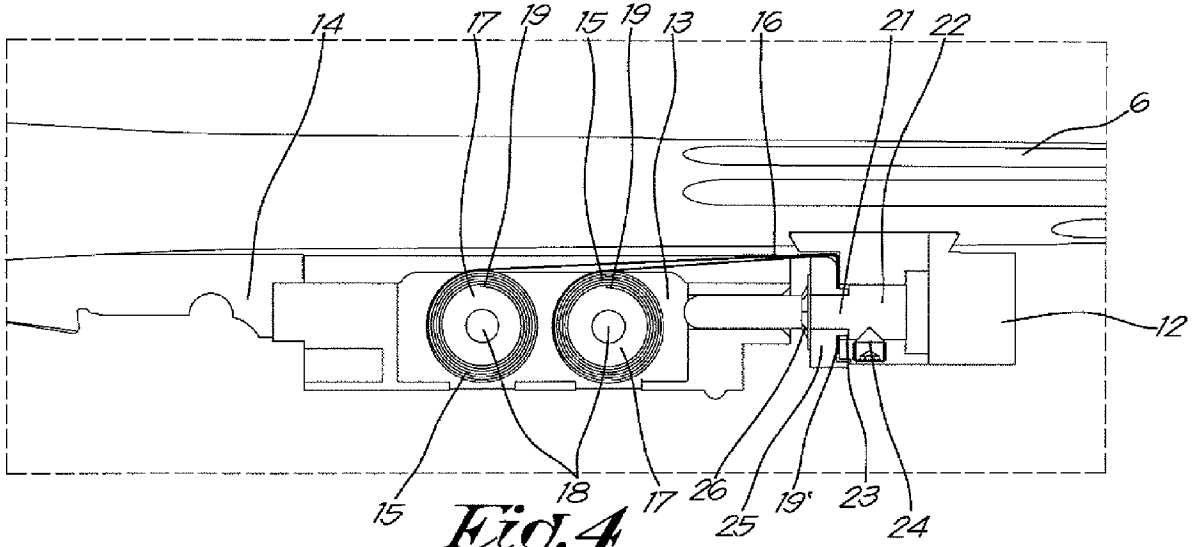
FIG. 4 shows the part indicated by the box F4 in FIG. 2 on a larger scale.
Figure 5:
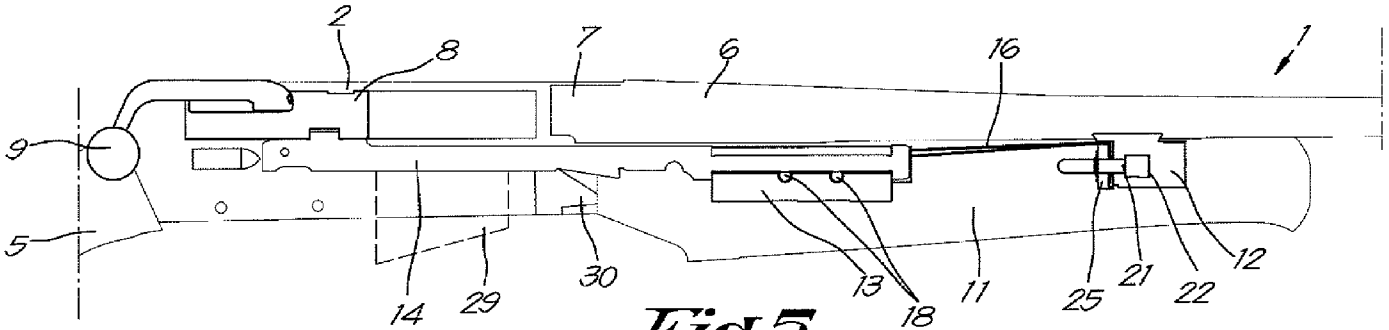
FIG. 5 is a longitudinal cross-section of the firearm of FIG. 2, but with the breech in the rear position.

The firearm 1 shown in the drawings as an example is a linear-bolt rifle essentially comprising:

a receiver 2;

a trigger guard 3 mounted partially in the receiver 2 and which comprises a percussion mechanism, not shown, that is activated by a trigger 4;

a stock 5 mounted at one end of the receiver 2;

a barrel 6 with a longitudinal axis X-X' mounted on the other end of the receiver 2;

an ammunition chamber 7 in the end of the barrel 6 that is mounted on the receiver 2 and can house a cartridge;

a mobile breech or slider 8 equipped with a loading lever 9 and mounted, in a way so that it can slide, in the receiver 2 in the prolongation of the axis X-X' of the barrel 6 between a closed position pressed against the barrel 6 as shown in FIG. 2, and a retracted position as shown in FIG. 5 enabling a cartridge to be loaded into the chamber 7;

a bolt 10 associated with the breech enabling the cartridge to be locked in the chamber by the linear movement of the breech;

a forend 11 affixed to the barrel 6 by a forend support 12;

a housing 13 connected to the breech 8 by two side runners 14, with the housing 13 being able to slide in the forend under the action of the linear movement of the breech, with the forend 11 covering the housing 13 and the side runners 14;

two 'constant-force' return springs 15 confined in the housing 13 and connecting the breech 8 and housing 13 assembly to the fixed forend support 12.

In the case of the example shown, each return spring 15 consists of a tape or flat strip 16 with a constant rectangular section and wound on itself around a winding axis Y-Y' which is transversal to the axis of the barrel, the spring being wound in the form of a flat spiral with the windings close to one another or in mutual contact.

Each return spring 15 is mounted on a bobbin 17 so that it can turn around a transverse shaft 18 which is coaxial with the winding axis Y-Y' and perpendicular to the axis X-X' of the barrel 6 and to the general plane of symmetry of the firearm 1 in such a way that the free inner end 19 of the spring 15 is allowed to rotate freely around the axis Y-Y'.

The free outer end 19' of each spring 15 is folded at an angle and is provided with a passage for a positioning shaft 21 that is provided with a head 22 of a larger diameter that is housed in a hole of the forend support 12, and which is kept in place by a locking screw 24.

The free end 19' of the springs 15 are fixed to the barrel by means of a holding plate 25, which is slid on the positioning shaft 21 and which is kept in place by a retaining circlip 26.

The positioning shaft 21 extends parallel to the axis X-X' of the barrel 6 opposite a centring hole 27 of the housing 13, with the positioning shaft 21 being provided with a conical entrance 28.

The firearm may be equipped with a magazine 19, shown schematically by the dotted line in FIG. 5, able to contain a series of cartridges and enabling the cartridges to be loaded one by one by a back and forth movement of the breech.

A breech stop lever is mounted so that it can pivot in the receiver stopping the breech in a rear locked position via the side runners when the magazine 29 is empty of cartridges.

The operation of a weapon according to the invention is analogous to the operation of a conventional weapon.

When a cartridge has been fired, with a manual reloading rifle the shooter must move the breech 8 back by acting on the loading lever 9.

In so doing, the case of the spent cartridge is extracted from the chamber 7 and ejected. The return springs 15 are unwound at the same time and placed under constant tension.

The force required to make the breech 8 move back will be essentially constant thanks to the choice of 'constant-force' springs 15, which gives greater comfort for the shooter.

To load a new cartridge from the magazine, the shooter just has to release the loading lever to send the breech 2 in the direction of the barrel 6 under the tensile effect of the unwound springs 15, which exerts a combined tensile force on the housing and thus on the breech via the side runners 14.

Towards the end of the movement of the breech 8 in the direction of the barrel 6, the positioning shaft 21 enters the conical entrance 28 of the centring hole 27 of the housing 13, fostering the centring of the housing 13 in the forend 11.

It is clear that the invention is not limited to manual and linear reloading weapons.

It is also clear that the springs 15 can be mounted in the reverse sense by mounting the wound part on the bobbins 17 in a fixed way with respect to the barrel 6 and the breech 8 and by fastening the free end of the springs 15 directly or indirectly to the breech 8.

The presence of a bobbin 17 and a shaft 18 is not necessary. The springs 15 can be retained in the housing 13 by other means, for example by being confined in a volute formed by the housing 13.

It is clear that a single spring 15 may suffice in certain cases or that it will be necessary to use more than two springs 15.

The 'constant-force' springs 15 do not necessarily have to be realised by springs in the form of a wound flat strip.

Moreover, it is not excluded combining different types of springs in an assembly to realise a spring of generally constant force, or combining 'constant-force' springs 15 with types of conventional helical springs with progressive force.

It is clear that the invention is by no means limited to the examples described above, and that many modifications can be made to the weapon described above without departing from the scope of the invention.

The invention claimed is:

1. A firearm comprising:

a receiver;

a barrel mounted with one end on the receiver;

a chamber in the one end to house a cartridge;

a breech equipped with a loading lever mounted in a way so that the breech can slide in the receiver in a prolongation of the barrel between an open position enabling a cartridge to be loaded into the chamber of the barrel and a closed position pressed against the barrel;

a bolt associated with the breech enabling the cartridge to be locked in the chamber;

at least one return spring to return the breech to its closed position, the return spring being a constant force tension spring that is mounted between the breech and a fixed support with respect to the receiver and the barrel.

2. The firearm according to claim 1, wherein the return spring is composed of a flat strip wound in the form of a flat spiral around a winding axis which is transversal to the axis of the barrel.

3. The firearm according to claim 2, wherein the flat strip is wound around itself.

4. The firearm according to claim 3, wherein an inner end of the return spring is not retained from rotating around the winding axis of the spring.

5. The firearm according to claim 3, wherein the flat strip is a strip with a rectangular cross-section which is predominantly constant on its part that is wound and in that the flat strip is wound in the form of a flat spiral with windings close to one another or with joined windings which are in mutual contact.

6. The firearm according to claim 2, wherein the return spring is mounted so that the return spring can rotate freely around its winding axis.

7. The firearm according to claim 6, wherein the return spring is mounted on a bobbin rotatable around a transverse shaft which is perpendicular to the axis of the barrel.

8. The firearm according to claim 1, wherein the return spring is mounted on or in a housing that is associated with the breech.

9. The firearm according to claim 1, wherein a free end of the return spring is affixed to a holding plate that is associated with the barrel.

10. The firearm according to claim 9, wherein said holding plate is associated with a forend support affixed to the barrel.

11. The firearm according to claim 10, wherein said free end of the return spring is provided with a passage for a positioning shaft that is affixed to the forend support and which keeps the holding plate in place.

12. The firearm according to claim 11, wherein the positioning shaft is provided with a head with a larger diameter that is housed in a hole of the forend support and which is kept in place by a locking screw.

13. The firearm according to claim 11, wherein the positioning shaft extends parallel to the axis of the barrel and in that the housing is provided with a centering hole in the prolongation of the positioning shaft.

14. The firearm according to claim 13, wherein the centering hole is provided with a conical entrance.

15. A firearm, comprising:

a receiver;

a barrel mounted with one end on the receiver;

a chamber in the one end to house a cartridge;

a breech equipped with a loading lever mounted, in a way so that the breech can slide in the receiver in a prolongation of the barrel between an open position enabling a cartridge to be loaded into the chamber of the barrel and a closed position pressed against the barrel;

a bolt associated with the breech enabling the cartridge to be locked in the chamber;

at least one return spring to return the breech to its closed position, mounted on or in a housing that is associated with the breech wherein the firearm is provided with a forend, wherein the housing is mounted, in a way so that the housing can slide in the forend by means of at least one side runner connecting the housing to the breech.

16. The firearm according to claim 15, wherein the firearm is equipped with a magazine and a breech stop lever mounted rotably in the receiver, stopping the breech in a rear locked position via the side runners when the magazine is empty of cartridges.

* * * * *